US008585238B2

(12) United States Patent
Krogman

(10) Patent No.: US 8,585,238 B2
(45) Date of Patent: Nov. 19, 2013

(54) DUAL ZONE LIGHTING APPARATUS

(75) Inventor: Mark James Krogman, Southlake, TX (US)

(73) Assignee: LSI Industries, Inc., Cincinnati, OH (US)

( * ) Notice: Subject to any disclaimer, the term of this patent is extended or adjusted under 35 U.S.C. 154(b) by 405 days.

(21) Appl. No.: 13/107,164

(22) Filed: May 13, 2011

(65) Prior Publication Data

US 2012/0287610 A1 Nov. 15, 2012

(51) Int. Cl.
*F21V 13/00* (2006.01)

(52) U.S. Cl.
USPC ..... 362/235; 362/237; 362/249.03

(58) Field of Classification Search
USPC ..... 362/103, 104, 128, 122, 158, 311.02, 362/311.04
See application file for complete search history.

(56) References Cited

U.S. PATENT DOCUMENTS

| | | | |
|---|---|---|---|
| 492,320 | A | 2/1893 | Bodkin |
| 1,484,978 | A | 2/1924 | Wheeler |
| 2,147,008 | A | 2/1939 | Blumenthal |
| 2,428,630 | A | 10/1947 | Lanter |
| D153,247 | S | 3/1949 | Winters |
| 3,193,001 | A | 7/1965 | Meckler |
| 3,311,743 | A | 3/1967 | Moore |
| 3,372,740 | A | 3/1968 | Kastovich et al. |
| 3,593,014 | A | 7/1971 | Vesely |
| 3,596,136 | A | 7/1971 | Fischer |
| D221,615 | S | 8/1971 | Simonds et al. |
| 3,801,815 | A | 4/1974 | Docimo |
| 3,845,292 | A | 10/1974 | Koziol |
| 3,890,126 | A | 6/1975 | Joseph |
| D235,797 | S | 7/1975 | Friedberg |
| 4,081,023 | A | 3/1978 | Edelstein et al. |
| 4,096,555 | A | 6/1978 | Lasker |
| 4,225,808 | A | 9/1980 | Saraceni |
| 4,231,080 | A | 10/1980 | Compton |
| 4,321,656 | A | 3/1982 | Gruver, Jr. |
| 4,433,328 | A | 2/1984 | Saphir et al. |
| 4,503,360 | A | 3/1985 | Bedel |
| 4,509,106 | A | 4/1985 | Mayer et al. |
| 4,591,960 | A | 5/1986 | Jones |
| D290,410 | S | 6/1987 | Haggard |
| 4,729,076 | A | 3/1988 | Masami et al. |

(Continued)

FOREIGN PATENT DOCUMENTS

| | | | |
|---|---|---|---|
| CN | 101105277 | | 1/2008 |
| CN | 101105277 | A * | 1/2008 |

(Continued)

OTHER PUBLICATIONS

Partial International Search Report from Corresponding PCT Application No. PCT/US2012/033910 dated Jul. 5, 2012.

(Continued)

*Primary Examiner* — David V Bruce
(74) *Attorney, Agent, or Firm* — McDermott Will & Emery LLP

(57) ABSTRACT

A lighting apparatus comprising a first lighting assembly comprising at least one lower light source configured to cast light over at least a near field and a second lighting assembly comprising at least one upper light source configured to cast light over at least a far field, the second lighting assembly mounted above the first lighting assembly.

21 Claims, 13 Drawing Sheets

(56) References Cited

U.S. PATENT DOCUMENTS

| | | | |
|---|---|---|---|
| 4,734,835 | A | 3/1988 | Vines et al. |
| 4,787,018 | A | 11/1988 | Poyer |
| 4,814,961 | A | 3/1989 | O'Brien et al. |
| 4,860,177 | A | 8/1989 | Simms |
| 4,871,944 | A | 10/1989 | Skwirut et al. |
| 4,941,072 | A | 7/1990 | Yasumoto |
| D310,887 | S | 9/1990 | Paris |
| 4,954,822 | A | 9/1990 | Borenstein |
| 4,969,074 | A | 11/1990 | Davis et al. |
| 4,982,176 | A | 1/1991 | Schwarz |
| 4,999,749 | A | 3/1991 | Dormand |
| D316,459 | S | 4/1991 | Kira |
| 5,010,452 | A | 4/1991 | Krebser et al. |
| D316,758 | S | 5/1991 | Kira |
| 5,075,833 | A | 12/1991 | Dormand |
| 5,136,287 | A | 8/1992 | Borenstein |
| 5,138,541 | A | 8/1992 | Kano |
| 5,142,463 | A | 8/1992 | Panagotacos et al. |
| 5,351,172 | A | 9/1994 | Attree et al. |
| D363,036 | S | 10/1995 | Sasaki |
| 5,537,301 | A | 7/1996 | Martich |
| 5,548,499 | A | 8/1996 | Zadeh |
| 5,557,170 | A | 9/1996 | Ooms |
| D377,229 | S | 1/1997 | Shalvi |
| 5,628,558 | A | 5/1997 | Iacono et al. |
| 5,636,057 | A | 6/1997 | Dick |
| 5,649,760 | A | 7/1997 | Beadle |
| 5,688,042 | A | 11/1997 | Madadi et al. |
| 5,785,418 | A | 7/1998 | Hochstein |
| 5,790,040 | A | 8/1998 | Kreier et al. |
| D398,412 | S | 9/1998 | Metchear |
| D404,505 | S | 1/1999 | Welsch |
| 5,867,099 | A | 2/1999 | Keeter |
| 5,924,788 | A | 7/1999 | Parkyn |
| 5,980,071 | A | 11/1999 | Hsieh |
| 5,993,027 | A | 11/1999 | Yamamoto et al. |
| 6,045,240 | A | 4/2000 | Hochstein |
| 6,050,707 | A | 4/2000 | Kondo et al. |
| 6,068,384 | A | 5/2000 | Tyson et al. |
| 6,154,362 | A | 11/2000 | Takahashi et al. |
| D435,130 | S | 12/2000 | Landefeld |
| D435,308 | S | 12/2000 | Christiansen |
| 6,166,640 | A | 12/2000 | Nishihira et al. |
| 6,183,114 | B1 | 2/2001 | Cook et al. |
| 6,193,603 | B1 | 2/2001 | Tai |
| D438,999 | S | 3/2001 | Bossy |
| D439,858 | S | 4/2001 | Decosse |
| D443,094 | S | 5/2001 | Landefeld |
| 6,234,649 | B1 | 5/2001 | Katougi |
| 6,276,814 | B1 | 8/2001 | Gough |
| 6,341,877 | B1 | 1/2002 | Chong |
| 6,350,043 | B1 | 2/2002 | Gloisten |
| 6,350,046 | B1 | 2/2002 | Lau |
| 6,367,949 | B1 | 4/2002 | Pederson |
| 6,379,024 | B1 | 4/2002 | Kogure et al. |
| 6,392,541 | B1 | 5/2002 | Bucher et al. |
| 6,402,337 | B1 | 6/2002 | LeVasseur et al. |
| 6,402,346 | B1 | 6/2002 | Liao et al. |
| 6,502,962 | B1 | 1/2003 | Menke et al. |
| 6,548,967 | B1 | 4/2003 | Dowling et al. |
| 6,560,038 | B1 | 5/2003 | Parkyn et al. |
| 6,573,536 | B1 | 6/2003 | Dry |
| D479,355 | S | 9/2003 | Dalton et al. |
| 6,632,006 | B1 | 10/2003 | Rippel et al. |
| 6,678,168 | B2 | 1/2004 | Kenny, Jr. et al. |
| 6,705,751 | B1 | 3/2004 | Liu |
| 6,815,724 | B2 | 11/2004 | Dry |
| 6,860,628 | B2 | 3/2005 | Robertson et al. |
| 6,871,983 | B2 | 3/2005 | Jacob et al. |
| 6,897,624 | B2 | 5/2005 | Lys et al. |
| 6,905,227 | B2 | 6/2005 | Wu |
| 6,927,541 | B2 | 8/2005 | Lee |
| 6,943,687 | B2 | 9/2005 | Lee et al. |
| 6,955,440 | B2 | 10/2005 | Niskamen |
| 6,965,715 | B2 | 11/2005 | Lei et al. |
| 6,974,233 | B1 | 12/2005 | Aubrey |
| 6,986,593 | B2 | 1/2006 | Rhoads |
| 6,994,452 | B2 | 2/2006 | Rozenberg et al. |
| 6,997,583 | B2 | 2/2006 | Broelemann |
| 7,014,341 | B2 | 3/2006 | King et al. |
| 7,021,787 | B1 | 4/2006 | Kuelbs |
| 7,059,740 | B2 | 6/2006 | Opolka |
| 7,098,486 | B2 | 8/2006 | Chen |
| 7,104,672 | B2 | 9/2006 | Zhang |
| 7,140,753 | B2 | 11/2006 | Wang et al. |
| 7,144,140 | B2 | 12/2006 | Sun et al. |
| 7,178,952 | B2 | 2/2007 | Bucher et al. |
| 7,182,547 | B1 | 2/2007 | Leonhardt et al. |
| 7,186,002 | B2 | 3/2007 | Matthews et al. |
| 7,207,690 | B2 | 4/2007 | Haugaard et al. |
| 7,221,271 | B2 | 5/2007 | Reime |
| D557,159 | S | 12/2007 | Sasaki et al. |
| D558,373 | S | 12/2007 | Flaherty et al. |
| 7,307,546 | B1 | 12/2007 | Partap |
| 7,322,718 | B2 | 1/2008 | Setomoto et al. |
| 7,325,998 | B2 | 2/2008 | Leonhardt et al. |
| 7,329,031 | B2 | 2/2008 | Liaw et al. |
| 7,348,723 | B2 | 3/2008 | Yamaguchi et al. |
| 7,387,405 | B2 | 6/2008 | Ducharme et al. |
| 7,425,084 | B2 | 9/2008 | Ruud et al. |
| 7,440,280 | B2 | 10/2008 | Shuy |
| 7,524,089 | B2 | 4/2009 | Park |
| 7,582,911 | B2 | 9/2009 | Lynch et al. |
| RE40,934 | E | 10/2009 | Ruud et al. |
| 7,604,380 | B2 | 10/2009 | Burton et al. |
| D610,730 | S | 2/2010 | Flaherty et al. |
| 7,985,004 | B1 | 7/2011 | Schach |
| 2002/0122309 | A1 | 9/2002 | Abdelhafez et al. |
| 2002/0145878 | A1 | 10/2002 | Venegas, Jr. |
| 2002/0152045 | A1 | 10/2002 | Dowling et al. |
| 2003/0222587 | A1 | 12/2003 | Dowling et al. |
| 2004/0022058 | A1 | 2/2004 | Birrell |
| 2004/0120152 | A1 | 6/2004 | Bolta et al. |
| 2004/0141326 | A1 | 7/2004 | Dry |
| 2005/0030761 | A1 | 2/2005 | Burgess |
| 2005/0036322 | A1 | 2/2005 | Veffer |
| 2005/0122229 | A1 | 6/2005 | Stevenson et al. |
| 2005/0168986 | A1 | 8/2005 | Wegner |
| 2005/0190567 | A1 | 9/2005 | Childers et al. |
| 2005/0207168 | A1 | 9/2005 | Chabert |
| 2005/0276053 | A1 | 12/2005 | Nortrup et al. |
| 2006/0092638 | A1 | 5/2006 | Harwood |
| 2006/0109661 | A1 | 5/2006 | Coushaine et al. |
| 2006/0126338 | A1 | 6/2006 | Mighetto |
| 2006/0164843 | A1 | 7/2006 | Adachi et al. |
| 2006/0193139 | A1 | 8/2006 | Sun et al. |
| 2006/0209545 | A1 | 9/2006 | Yu |
| 2006/0215408 | A1 | 9/2006 | Lee |
| 2006/0262545 | A1 | 11/2006 | Piepgras et al. |
| 2007/0008726 | A1 | 1/2007 | Brown |
| 2007/0030686 | A1 | 2/2007 | Haugaard et al. |
| 2007/0076416 | A1 | 4/2007 | Leonhardt |
| 2007/0159827 | A1 | 7/2007 | Huang |
| 2007/0171647 | A1 | 7/2007 | Artwohl |
| 2007/0211470 | A1 | 9/2007 | Huang |
| 2007/0230172 | A1 | 10/2007 | Wang |
| 2007/0230183 | A1 | 10/2007 | Shuy |
| 2007/0230184 | A1 | 10/2007 | Shuy |
| 2007/0247853 | A1 | 10/2007 | Dorogi |
| 2007/0279909 | A1 | 12/2007 | Li |
| 2008/0007955 | A1 | 1/2008 | Li |
| 2008/0043472 | A1 | 2/2008 | Wang |
| 2008/0080188 | A1 | 4/2008 | Wang |
| 2008/0084701 | A1 | 4/2008 | Van De Ven et al. |
| 2008/0158887 | A1 | 7/2008 | Zhu et al. |
| 2008/0165535 | A1 | 7/2008 | Mazzochette |
| 2008/0204888 | A1 | 8/2008 | Kan et al. |
| 2008/0205062 | A1 | 8/2008 | Dahm et al. |
| 2008/0212333 | A1 | 9/2008 | Chen |
| 2008/0304269 | A1 | 12/2008 | Pickard et al. |
| 2009/0052175 | A1 | 2/2009 | Xu et al. |
| 2009/0080189 | A1 | 3/2009 | Wegner |
| 2009/0086476 | A1 | 4/2009 | Tickner et al. |
| 2009/0086481 | A1 | 4/2009 | Wegner |

(56) References Cited

U.S. PATENT DOCUMENTS

| | | | |
|---|---|---|---|
| 2010/0026479 | A1 | 2/2010 | Tran |
| 2010/0157595 | A1 | 6/2010 | Lin et al. |
| 2011/0019401 | A1 | 1/2011 | Chen et al. |

FOREIGN PATENT DOCUMENTS

| | | | | |
|---|---|---|---|---|
| DE | 855065 | | | 11/1952 |
| DE | 855065 | C | * | 11/1952 |
| DE | 29807052 | | | 7/1998 |
| DE | 29807052 | U1 | * | 7/1998 |
| EP | 0813353 | | | 12/1997 |
| EP | 1431653 | A2 | | 6/2004 |
| GB | 2403499 | | | 1/2005 |
| JP | 11154766 | | | 8/1999 |
| JP | 2006172895 | | | 6/2006 |
| JP | 2008171584 | | | 7/2008 |
| JP | D1355524 | | | 4/2009 |
| TW | 309349 | | | 6/1997 |
| WO | WO9946962 | | | 9/1999 |
| WO | WO 2005/078336 | A1 | | 8/2005 |
| WO | 2010146534 | A1 | | 12/2010 |

OTHER PUBLICATIONS

Search Report from Corresponding Taiwan Design Patent Application No. 100306089 dated Sep. 4, 2012.

Greenlee-Hyperion Brochure, LSI Lighting Solutions, 8 pages (2008).

Greenlee-Hyperion Datasheet, LSI Lighting Solutions, 2 pages (2010).

Hydrel, 3110 LED Louver Bollard Round Dome, www.hydrel.com, 2 pages (2010).

Hydrel, 3120 LED Round Louver Bollard Flat, www.hydrel.com, 2 pages (2010).

LED Bollard, BRM832/BRM836 School Bollards Featuring Motor Response, Philips Gardco, www.sitelighting.com, 2 pages (2010).

LED Bollards Landscape and Pathway Lighting, Gardco Lighting, 12 pages (2008).

LED Multi Level, BetaLED; A Division of Ruud Lighting, www.betaLED.com, 2 pages (2011).

LED Pathway Light, BetaLED; A Division of Ruud Lighting, www.betaLED.com, 2 pages (2010).

LSI Outdoor Lighting, The Bollard Series Brochure, 4 pages (2004).

International Search Report and the Written Opinion dated Feb. 7, 2013 from International Application No. PCT/US2012/033910.

Response dated Mar. 8, 2013 to Office Action dated Sep. 11, 2012 from Corresponding Taiwan Patent Application No. 100306089.

Search Report dated Jul. 25, 2013 from Corresponding Taiwan Patent Application No. 102301657.

* cited by examiner

DUAL ZONE LIGHTING APPARATUS

FIELD OF THE DISCLOSURE

The present disclosure relates generally to a lighting apparatus and, more particularly, to a lighting apparatus having at least two light emitting zones, each configured to light a different area. In one particular aspect, the present disclosure relates to a bollard having a first light source for lighting ground near to the base of the bollard and a second light source for lighting ground beyond the ground lighted by the first light source.

The present disclosure also relates to a one-piece mount for a plurality of light sources, such as light emitting diodes (LED) by way of example only, to precisely locate each light source and provide optimum heat communication away from the light sources.

BACKGROUND OF THE DISCLOSURE

Bollards are well known for the lighting of walkways and the like. Prior known bollards comprise either a single aperture directing light from a light source to cover a predetermined field of surrounding ground or a plurality of stacked louvers each having a light source wherein each light source/louver combination is configured to direct light at the same angle with respect to the bollard and thus light essentially the same predetermined field. These known prior art bollards have cast light either on the field immediately adjacent the base of the bollard (i.e. "near field") or on a field spaced from the base of the bollard (i.e. "far field"), but have not cast adequate light on both fields.

Prior to the lighting apparatus of the present disclosure, lighting both near and far fields required multiple bollards positioned closely together to create overlapping fields. This caused inefficiencies in both capital expenditures on equipment as well as energy consumption by the lighting apparatuses.

SUMMARY OF THE DISCLOSURE

The present disclosure provides a lighting apparatus that overcomes these deficiencies in prior lighting apparatuses.

A lighting apparatus comprising: a) a first lighting assembly comprising at least one lower light source configured to cast light over at least a near field; and b) a second lighting assembly comprising at least one upper light source configured to cast light over at least a far field, the second lighting assembly mounted above the first lighting assembly. At least one of the upper and lower light sources may be comprised of an LED. The upper light sources may be configured to cast a narrow flood beam. The lower light sources may be configured to cast a wide flood beam. The upper light sources may be directed downward at a first angle from horizontal and the lower light sources are directed downward at a second angle from horizontal different from the first angle. The first angle may be smaller than the second angle. The first angle may be approximately 25.5° and the second angle may be approximately 38.6°. The lighting apparatus may be configured as a bollard wherein the second lighting assembly is located immediately over the first lighting assembly. At least one of the first and second lighting assemblies may comprise a light source mount comprising (a) a base defining a plane, (b) a plurality of tongues extending from the base at an angle to said plane, and (c) at least one of the plurality of tongues being configured to receive the light source.

A bollard configured as a column with an outer shell, the bollard comprising: (a) a lower light aperture adjacent the shell and a lower lighting assembly comprising at least one lower light source configured to cast light over at least a near field; and (b) an upper light aperture adjacent the shell and a second lighting assembly comprising at least one upper light source configured to cast light over at least a far field, the second lighting assembly mounted above the first lighting assembly. At least one of the upper and lower light sources may be an LED. The upper light sources may be configured to cast a narrow flood beam. The lower light sources may be configured to cast a wide flood beam. The upper light sources may be directed downward at a first angle from horizontal and the lower light sources may be directed downward at a second angle from horizontal different from the first angle. The first angle may be smaller than the second angle. The first angle may be approximately 25.5° and the second angle may be approximately 38.6°. The second lighting assembly may be located immediately over the first lighting assembly. At least one of the first and second lighting assemblies may further comprise a light source mount comprising (a) a base defining a plane, (b) a plurality of tongues extending from the base at an angle to said plane, and (c) at least one of the plurality of tongues being configured to receive the light source.

A light source mount for a lighting assembly, the light source mount comprising (a) a base defining a plane, (b) a plurality of tongues extending from the base at an angle to said plane, and (c) each tongue configured to receive one or more light sources. Each light source may be comprised of an LED. Each of the plurality of tongues may extend from the base at the same angle to the plane. The base may define a perimeter and the plurality of tongues may extend from the perimeter. The base may define a perimeter and the plurality of tongues may extend from the base about the entirety of the perimeter.

The ornamental shape and design of various disclosed embodiments, as shown in the figures, is also disclosed and claimed in a design patent application filed in the United States Patent and Trademark Office on the same day as the filing of this application. The entirety of that design patent application is incorporated herein by reference.

Other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. It is to be understood that the disclosure is intended in an illustrative rather than in a limiting sense, as it is contemplated that modifications will be apparent to those skilled in the art, within the spirit of the invention and the scope of the appended claims. Like components are labeled with identical reference numbers for ease of understanding.

Figure 1:
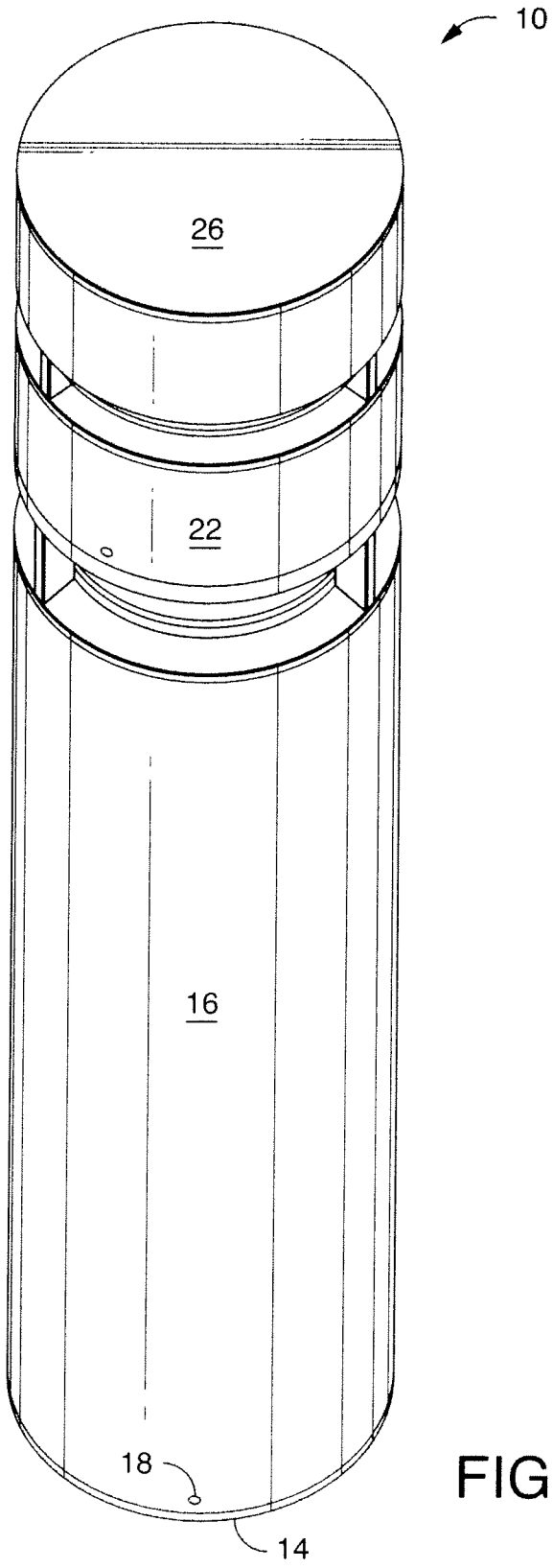
FIG. 1 is a perspective view of one embodiment of a lighting apparatus, in accordance with the present disclosure.
Figure 2A:
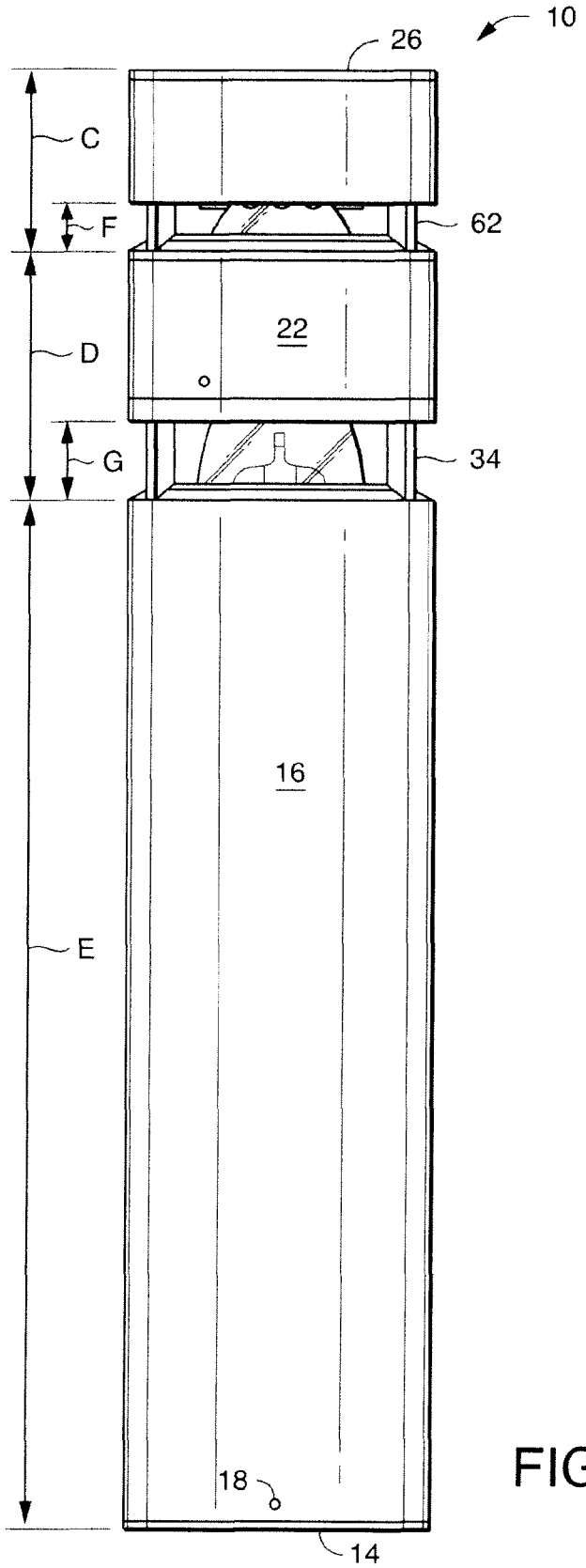
FIG. 2A is an elevational view of the lighting apparatus depicted in FIG. 1.
Figure 2B:
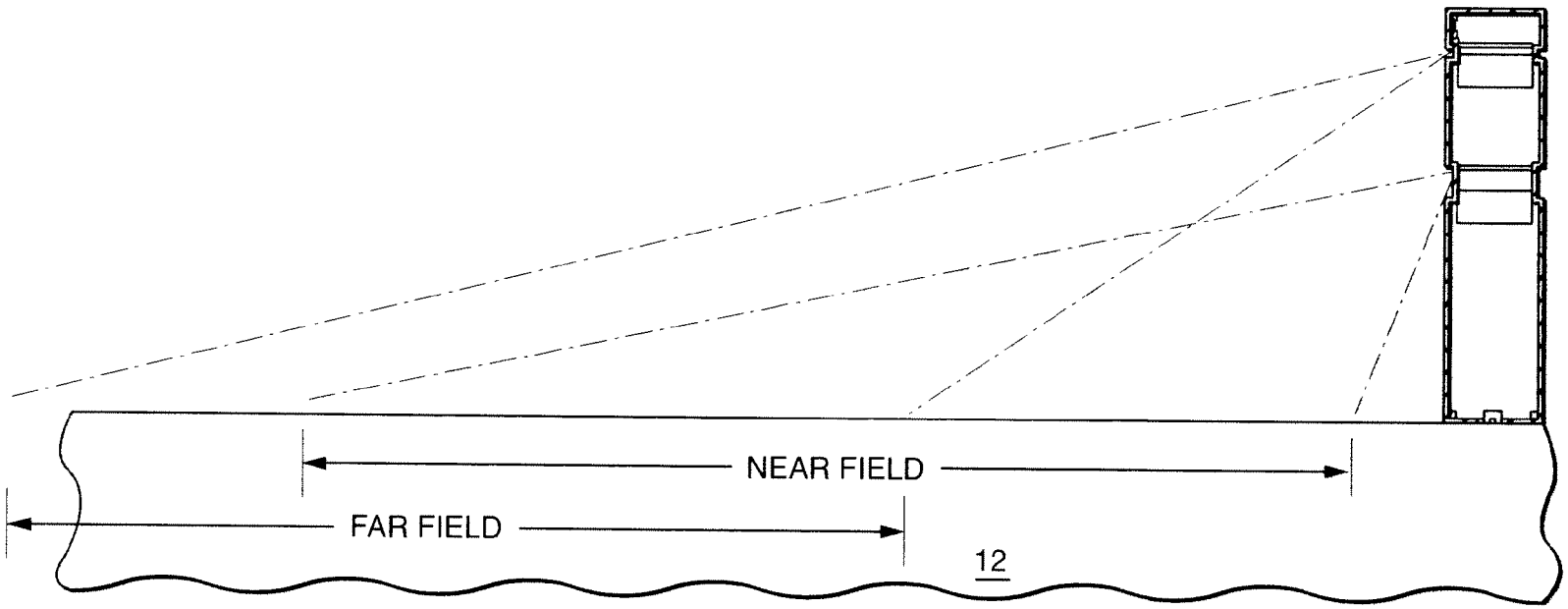
FIG. 2B is an elevational view of the lighting apparatus depicted in FIG. 1, depicted in cross-section and showing light cast from each of two light sources of that lighting apparatus in one direction (light not shown cast in the other direction for simplification of the figure)
Figure 2C:
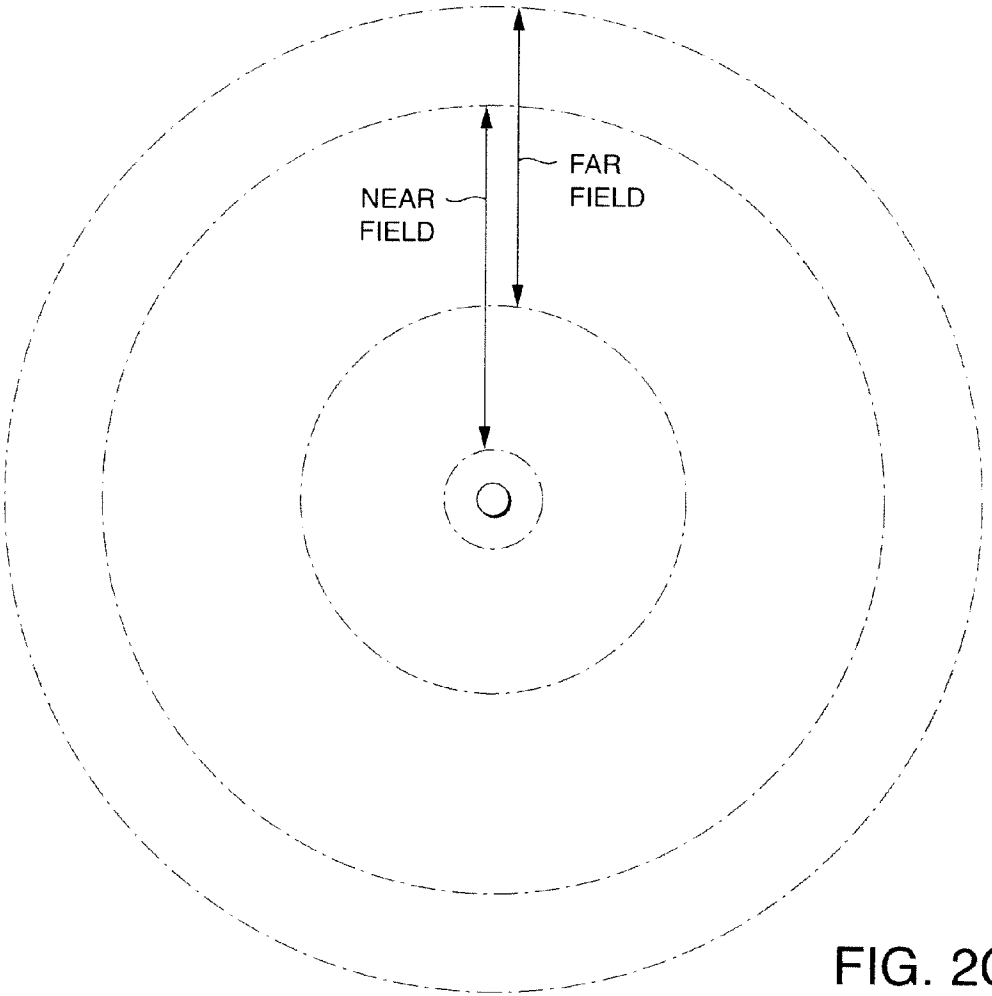
FIG. 2C is a top plane view of the lighting apparatus, and light cast thereby, depicted in FIG. 2B.
Figure 3A:
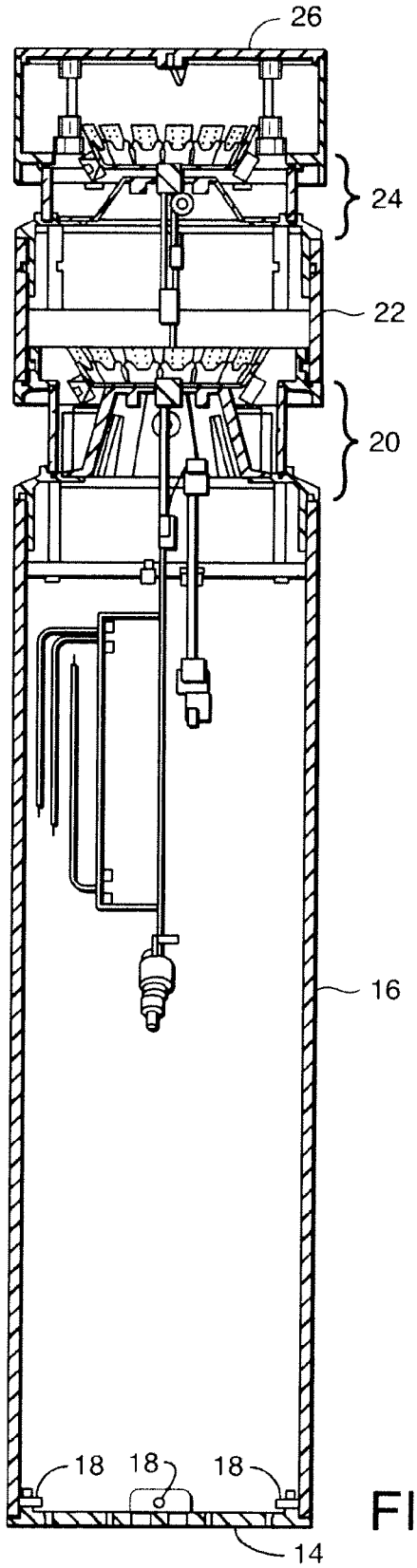
FIG. 3A is a cross-sectional view of the lighting apparatus depicted in FIG. 1.
Figure 3B:
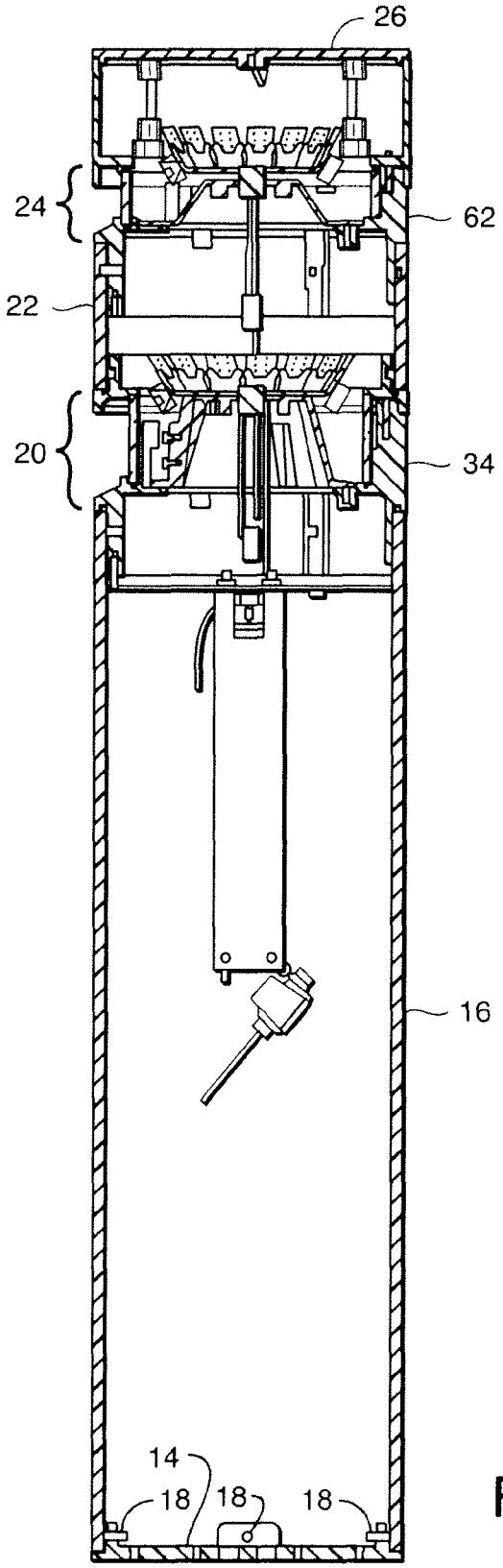
FIG. 3B is an alternate cross-sectional view of the lighting apparatus depicted in FIG. 1.

A lighting apparatus 10 according to the present disclosure is depicted in FIG. 1 in the configuration of a cylindrical bollard extending vertically from the ground 12 (see FIG. 2B). The ground 12 on which the lighting apparatus 10 is mounted my consist of earth, concrete, asphalt or any other substance. The lighting apparatus 10 comprises a base mounting bracket 14 employed to secure the lighting apparatus 10 to the ground. The base mounting bracket 14 is configured to be secured to the ground by methods and configurations typical for mounting bollards to the ground. A base shell 16 is secured to the base mounting bracket 14 with screws 18 or the like as is typical for bollards. A lower aperture frame 20 is mounted atop the base shell 16 to define an aperture through which light may project. The lower aperture frame 20 is depicted in greater detail in FIG. 6A and will be discussed in greater detail below.

An intermediate shell 22 sits atop the lower aperture frame 20 and spaces the lower aperture frame 20 from an upper aperture frame 24 which defines an aperture through which light may project. The upper aperture frame 24 is depicted in greater detail in FIG. 5A and will be discussed in greater detail below. A cap 26 sits atop the upper aperture frame 24. While the shells 16 and 22 and the cap 26 are depicted as cylindrical, other configurations are contemplated and are not inconsistent with this disclosure. Further, the cap 26 is depicted as having a flat top, but other configurations, such as—by way of example only—domed, are also within the scope of this disclosure.

Figure 4:
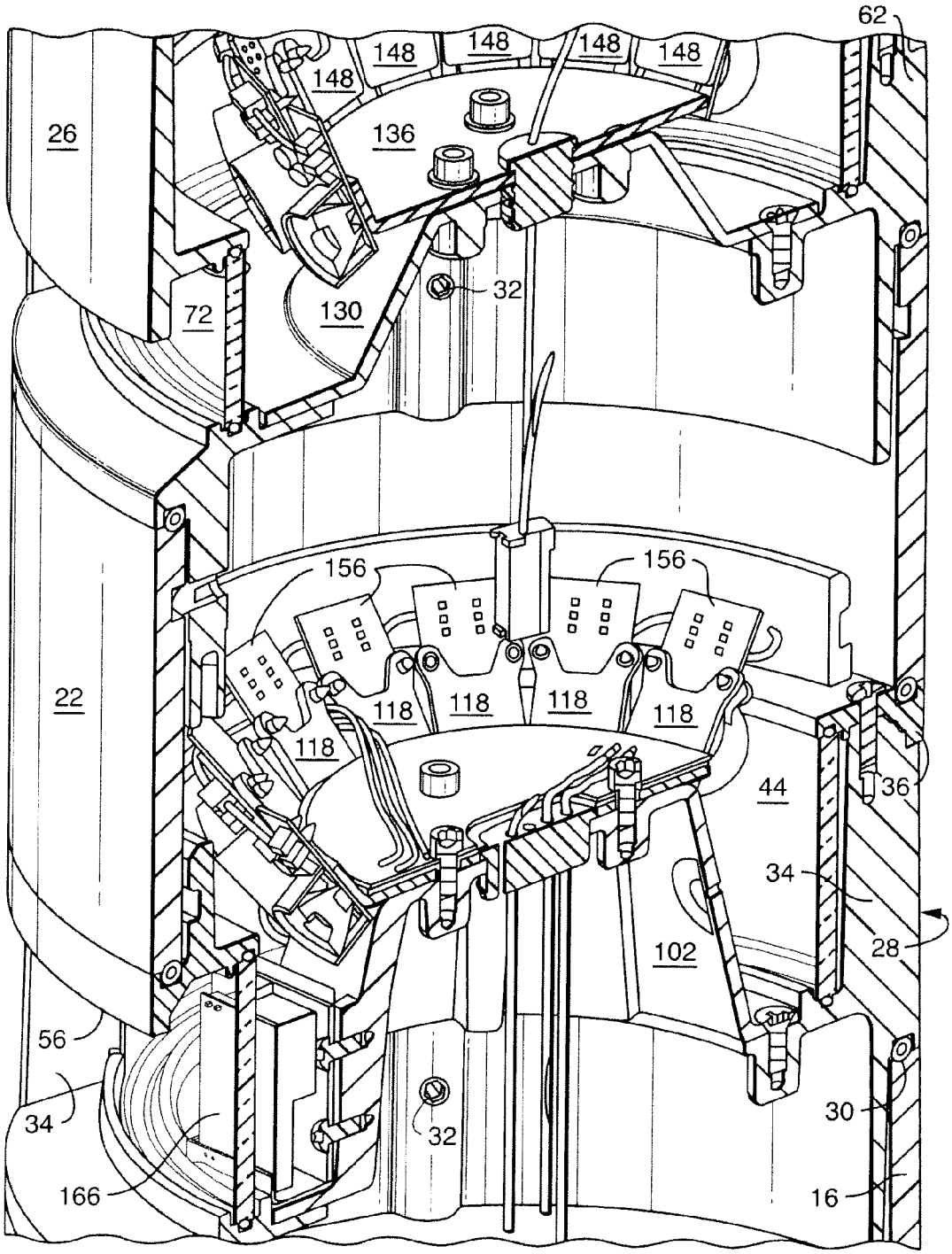
FIG. 4 is a perspective cross-sectional view of two lighting assemblies of the lighting apparatus depicted in FIG. 1.
Figure 6A:
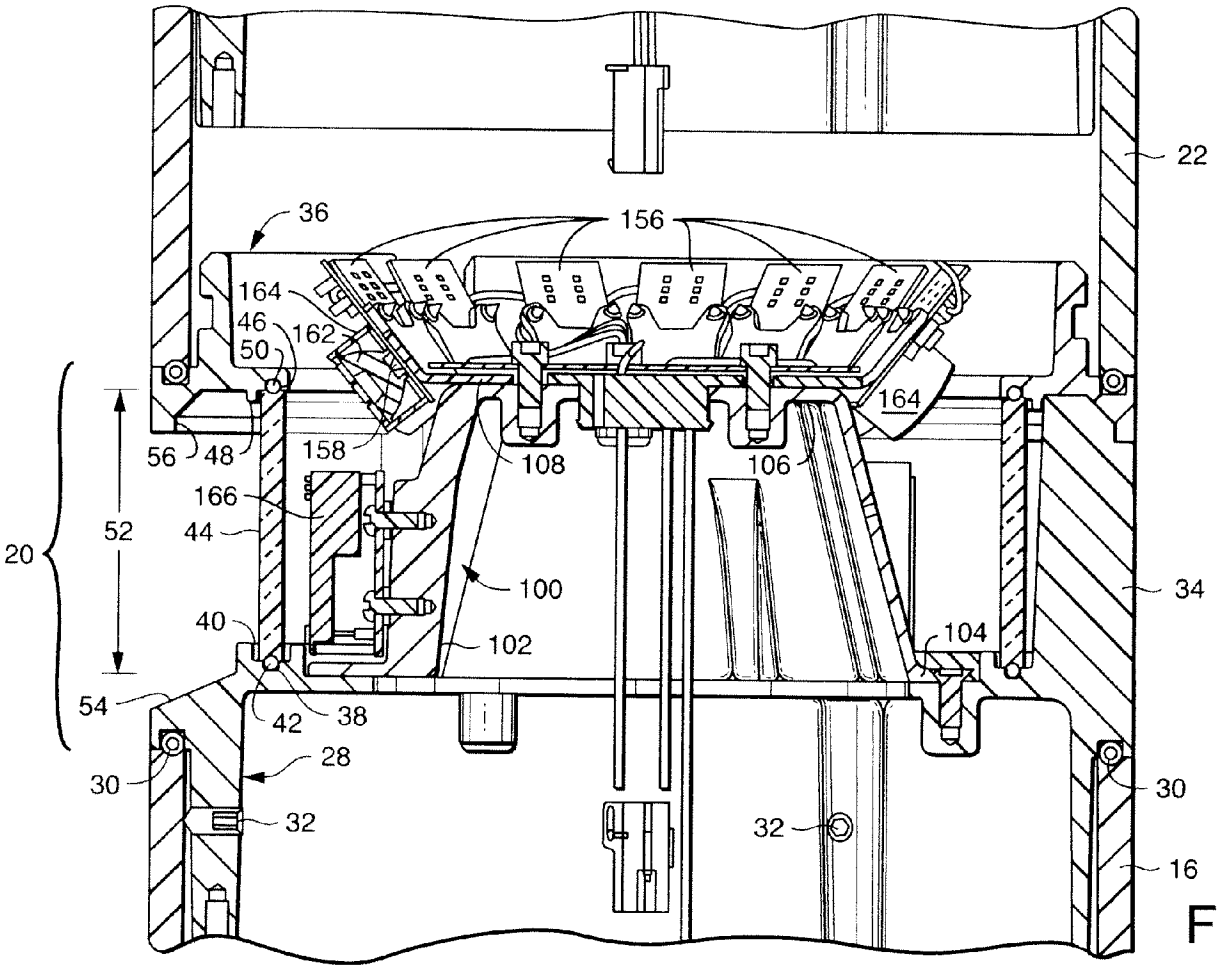
FIG. 6A is a cross-sectional view of the lower lighting assembly depicted in FIG. 1 in that lighting apparatus.
Figure 6B:
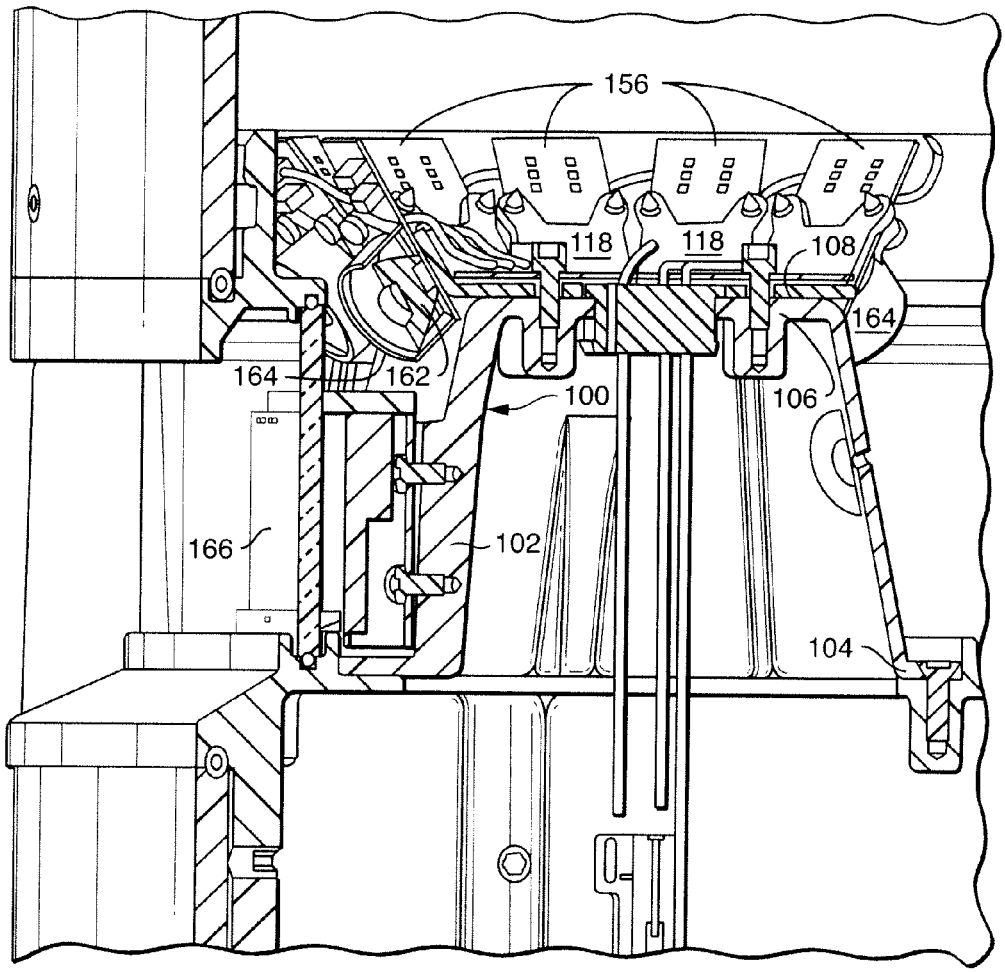
FIG. 6B is the cross-sectional view of FIG. 6A rotated slightly about its vertical axis.
Figure 6C:
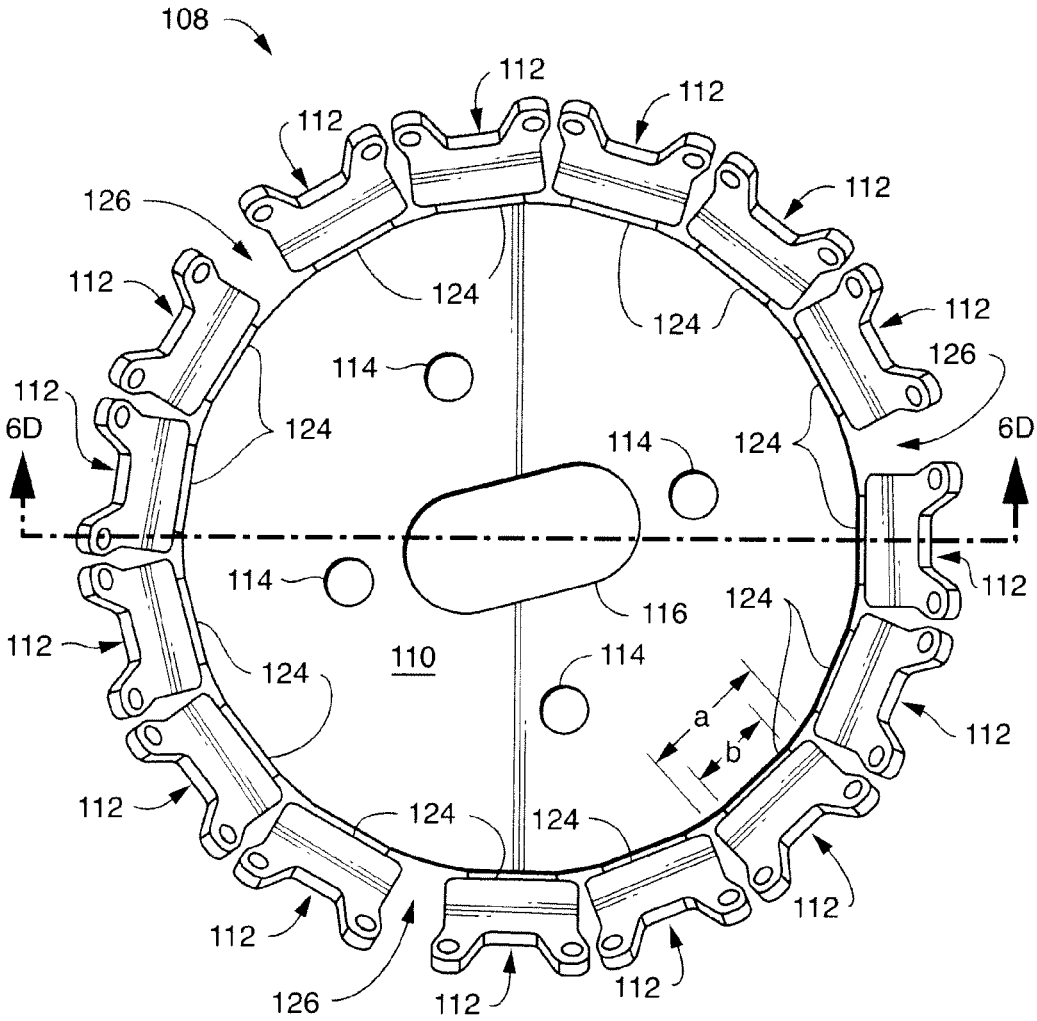
FIGS. 6C-6D are a top plane view of a mount of the lower light source and a cross-sectional view taken through line 6D-6D thereof.
Figure 6D:
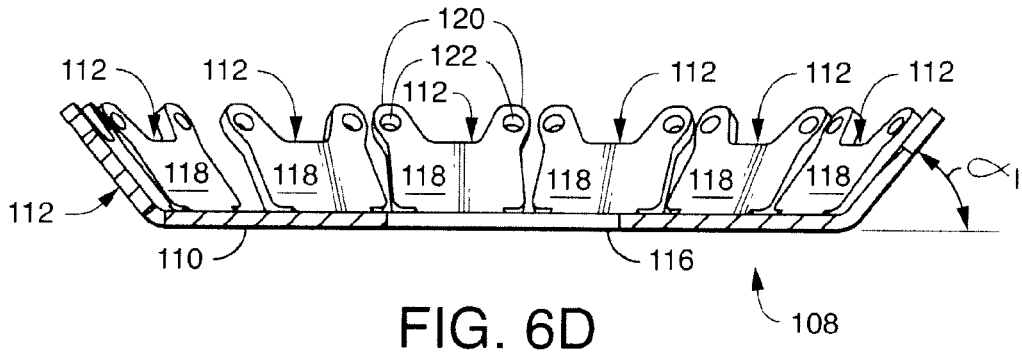

The particulars of the lower aperture frame 20 can be seen in FIGS. 4, 6A and 6B. The lower aperture frame 20 has a base ring 28 sitting atop the lower shell 16 with a gasket 30 located there between to seal out moisture, dust or contaminants. The base ring 28 can be fixed to the lower shell 16 by known mechanisms, such as one or more screws 32, adhesives or other known manners. The lower base ring 28, as shown, comprises a tail extending downward below the uppermost rim of the lower shell 16 a sufficient amount to provide the lower aperture frame 20 with rigidity and stability within the low shell 16 upon application of the screws or other manner of fixing the base ring 28 to the lower shell 16. The base ring 28 comprises three fins 34 extending radially outward and spaced each from the others at approximately 120°. The lower aperture frame 20 also has a cap ring 36 which sits atop the upper end of the base ring fins 34 and can be mounted thereto in known manners, such as by the screw depicted in FIG. 4. The base ring 28 comprises a pair of nested grooves 38, 40 to receive, respectively, a lens gasket 42 and a lens 44. In one exemplary embodiment, the lighting apparatus 10 has an outside diameter of approximately 8.625 inches and a lens 44 that is 59 mm tall and has a 170 mm diameter. The cap ring 36 comprises a groove 46 and lip 48 to receive, respectively, a lens gasket 50 and the lens 44. Other than the three fins 34 and the holes for the screws 32, the base ring 16 and cap ring 36 are circumferentially uniform, but need not be.

The lower aperture frame 20 defines a lower light aperture 52 at the lens 44 (see FIG. 6A). As depicted in FIG. 2B, light transmitted through the lower light aperture is intended to be directed toward the ground proximate to the lighting apparatus 10, which is sometimes referred to as the near field. The base ring 28 of the lower aperture frame 20 comprises a sloped land 54 extending between its outer perimeter and the lens groove 40. The sloped land 54 is sloped downward, as depicted, to permit light passing through the lower light aperture 52 to pass downward toward the ground without being blocked by the base ring 28. The cap ring 36 of the lower aperture frame 20 comprises a blind 56 hanging downward to partially block the view of the lighting apparatus located inward thereof, as described in more detail below. In the depicted embodiment, the blind is uniform with the outer perimeter of the intermediate shell 22.

Figure 5A:
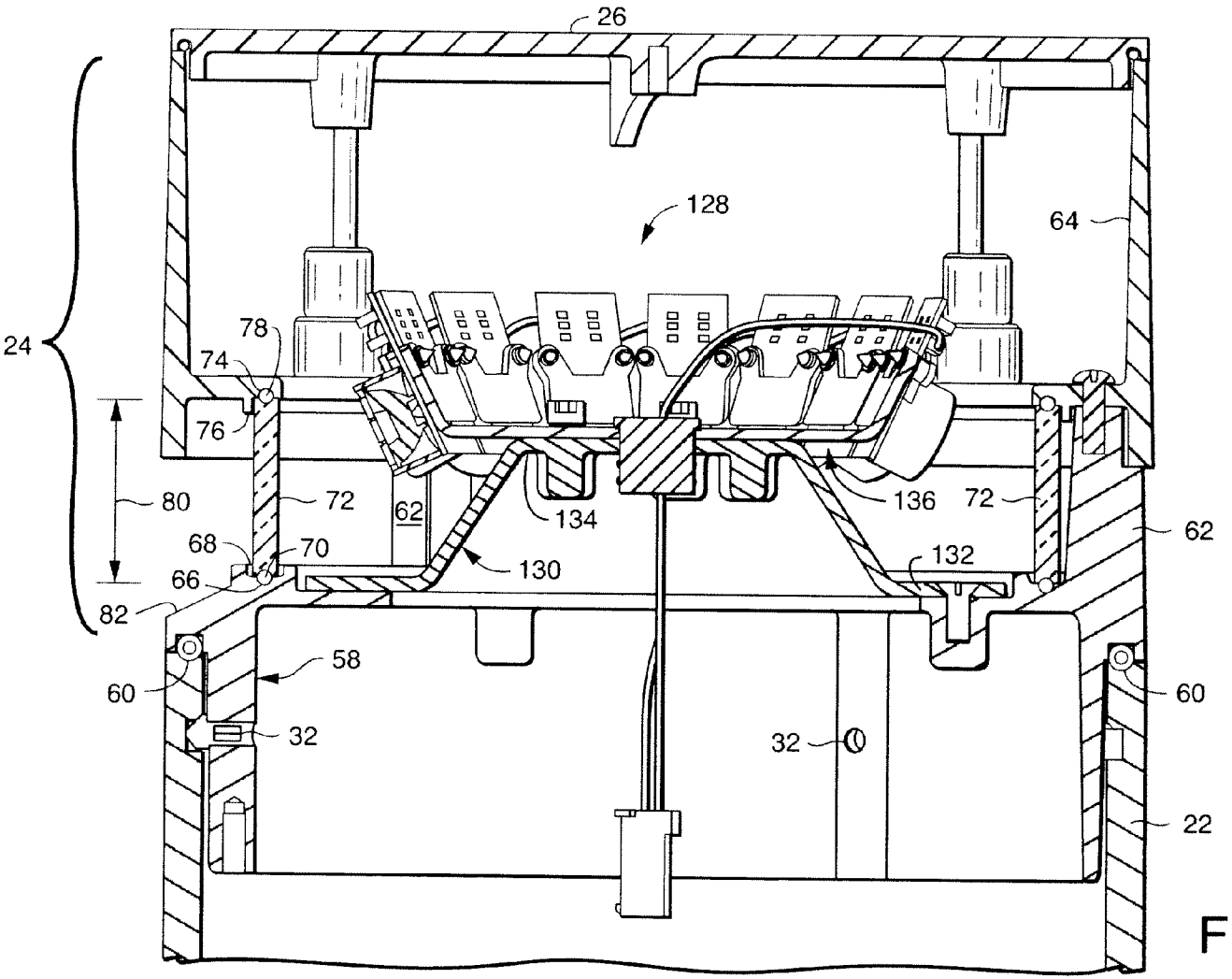
FIG. 5A is a cross-sectional view of the upper lighting assembly depicted in FIG. 1.
Figure 5B:
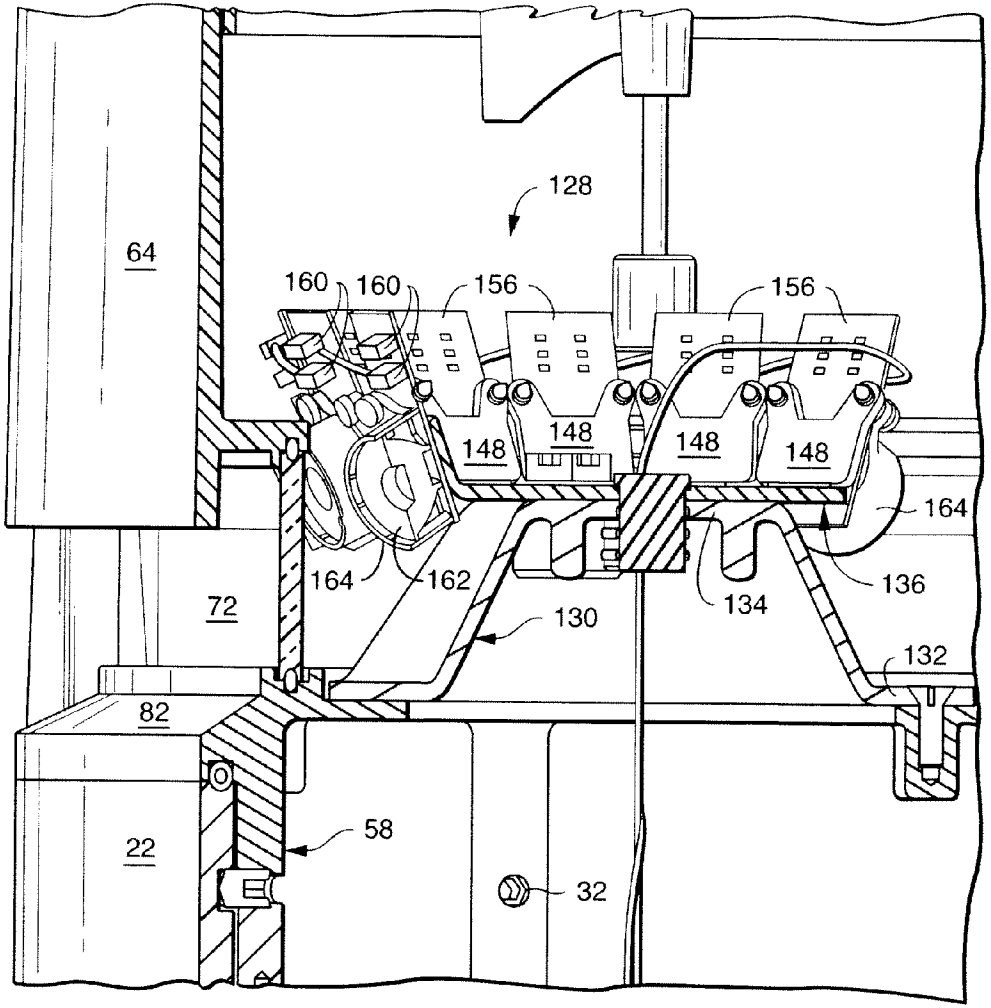
FIG. 5B is the cross-sectional view of FIG. 5A rotated slightly about its vertical axis.
Figure 5C:
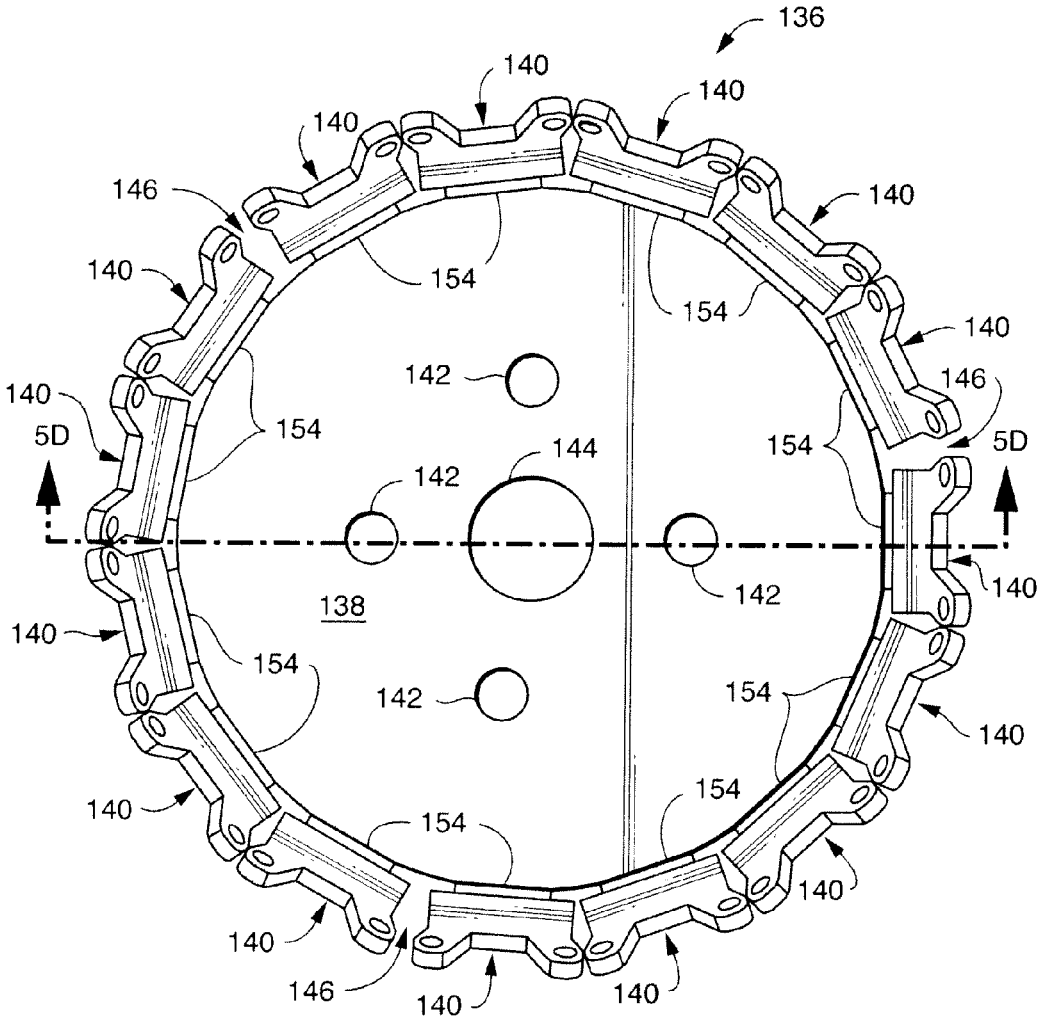
FIGS. 5C-5D are a top plane view of a mount of the upper light source and a cross-sectional view taken through line 5D-5D thereof.
Figure 5D:
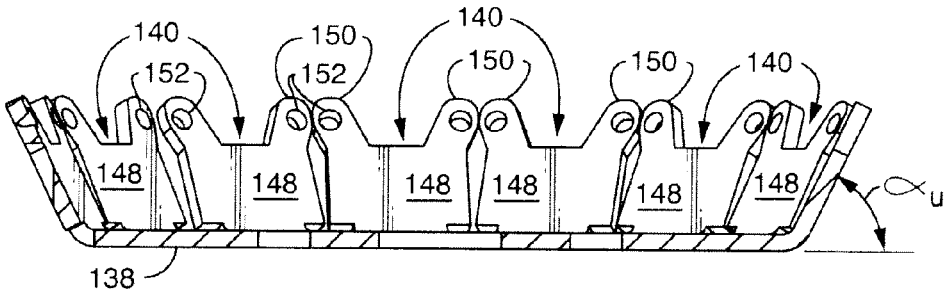

The particulars of the upper aperture frame 24 can be seen in FIGS. 4, 5A and 5B. The upper aperture frame 24 has a base ring 58 sitting atop the intermediate shell 22 with a gasket 60 located there between to seal out moisture, dust or contaminants. The base ring 58 can be fixed to the intermediate shell 22 by known mechanisms, such as one or more screws 32, adhesives or other known manners. The upper base ring 58, as shown, comprises a tail extending downward below the uppermost rim of the intermediate shell 22 a sufficient amount to provide the upper aperture frame 24 with rigidity and stability within the intermediate shell 22 upon application of the screws 32 or other manner of fixing the upper base ring 58 to the intermediate shell 22. The upper base ring 58 comprises three fins 62 extending radially outward and spaced each from the others at approximately 120°. The upper aperture frame 24 also has a cap ring 64 which sits atop the upper end of the base ring fins 62 and can be mounted thereto in known manners, such as by the screw partially depicted in FIG. 4. The upper base ring 58 comprises a pair of nested grooves 66, 68 to receive, respectively, a lens gasket 70 and a lens 72. In one exemplary embodiment, the lighting apparatus 10 has an outside diameter of approximately 8.625 inches and a lens 72 that is 39 mm tall and has a 180 mm diameter. The upper cap ring 64 comprises a groove 74 and lip 76 to receive, respectively, a lens gasket 78 and the lens 72. Other than the three fins 62 and the holes for the screws 32, the upper base ring 58 and upper cap ring 64 are circumferentially uniform, but need not be.

The upper aperture frame 24 defines an upper light aperture 80 at the lens 72 (see FIG. 5A). As depicted in FIG. 2B, light transmitted through the upper light aperture is intended to be directed toward the ground spaced from the lighting apparatus 10, sometimes referred to as the far field, but overlapping somewhat with the near field. The base ring 58 of the upper aperture frame 24 comprises a sloped land 82 extending between its outer perimeter and the lens groove 68. The sloped land 82 is sloped downward, as depicted, to permit light passing through the lower light aperture 80 to pass downward toward the far field without being blocked by the base ring 58. The cap ring 64 of the upper aperture frame 24 comprises a blind 84 hanging downward to partially block the view of the lighting apparatus located inward thereof, as described in more detail below. In the depicted embodiment, the blind is uniform about its perimeter with the remainder of the upper cap ring that extends upward to engage the cap 26.

Inward of the lower light aperture 52 resides a lower lighting assembly 100 (which can be seen in FIGS. 4, 6A and 6B) comprising a lower light support 102 having a bottom flange 104, mounted to the lower aperture base ring 28 by one or more screws or the like, and extending upward in a frusto-conical shape to a lower light support plateau 106. A lower light source mount 108 is fixed to the lower light support plateau 106. The lower light source mount 108 comprises a base 110 with a plurality of tongues 112 extending from the base 110 about its perimeter. The base 110 comprises mounting holes 114 and a pass through hole 116 for the wiring necessary to operate the lighting apparatus 10. The base 110 in the exemplary embodiment depicted in the Figures is generally circular in shape to correspond with the circular cross-section of the exemplary lighting apparatus 10 of which it is a part. It is contemplated, however, that the shape of the base of a light source mount (lower or upper, as discussed below) could, but need not, correspond to the shape of the lighting apparatus of which it is a part in order to locate the associated tongues (and the light sources mounted thereon, as discussed below) in a manner corresponding with the perimeter of the lighting apparatus to maximize the efficiency and direction of light. By way of example only, a square shaped lighting apparatus could use a square shaped lower light source mount base. It is also contemplated, however, that a circular or other shape light source mounting base could be used with any shape lighting apparatus.

The tongues 112 are spaced approximately evenly about the perimeter of the base 110. In the depicted embodiment in which the lighting apparatus 10 comprises three fins 34 spaced 120° from each other, the tongues 112 are spaced to leave three gaps 126, each aligned with one of the fins 34. By spacing the tongues 112 in this manner to avoid the fins 34, the light emitted from light sources located on each tongue 112 (as described below) will not be blocked by the fins 34.

Each tongue 112 comprises a light source mounting plate 118 having two ears 120 extending from a distal end thereof, each ear defining a hole 122 therein. In the depicted embodiment, the tongues 112 are approximately rectangular in shape, having a width "a" which narrows to a neck 124 having a width of "b" where the tongue 112 meets the base 110 of the light source mounting plate 118 in order to ease the bending of the tongue 112 from the flat position resulting from the lower light source mount 108 being cut from a flat piece of metal. In one exemplary embodiment, the lower light source mount 108 is precision manufactured from a single piece of sheet aluminum in order to maximize heat transfer precision of the angles. In another exemplary embodiment, the lower light source mount 108 can be precision cut from 0.090 inch thick 3033-H14 or 5052-H32 aluminum with a dimension a of 0.748 inches and a neck 124 dimension b of 0.500 inches to facilitate bending of the tongues 112.

Inward of the upper light aperture 80 resides an upper lighting assembly 128 (depicted in FIGS. 4, 5A and 5B) comprising an upper light support 130 having a bottom flange 132, mounted to the upper aperture base ring 58 by one or more screws or the like, and extending upward in a frusto-conical shape to an upper light support plateau 134. An upper light source mount 136 is fixed to the upper light support plateau 134. The upper light source mount 136 comprises a base 138 with a plurality of tongues 140 extending from the base 138 about its perimeter. The base 138 comprises mounting holes 142 and a pass through hole 144 for the wiring necessary to operate the lighting apparatus 10. The base 138, in the exemplary embodiment depicted in the Figures, is generally circular in shape to correspond with the circular cross-section of the exemplary lighting apparatus 10 of which it is a part. Other shapes are also contemplated, as discussed above with respect to, and for the same reasons as, the lower light source mount 108.

As with the lower light source mount 108, the tongues 140 of the upper light source mount 128 are spaced approximately evenly about the perimeter of the base 138. In the depicted embodiment, the tongues 140 are spaced to leave three gaps 146, each aligned with one of the fins 62 of the upper aperture base ring 58, such that the light emitted from light sources located on each tongue 140 (as described below) will not be blocked by the fins 62.

Each tongue 140 comprises a light source mounting plate 148 having two ears 150 extending from a distal end thereof, each ear defining a hole 152 therein. In the depicted embodiment, the tongues 140 are approximately rectangular in shape, having a width "a'" which narrows to a neck 154 having a width of "b'" where the tongue 140 meets the base 138 of the light source mounting plate 148 in order to ease the bending of the tongue 140 from the flat position resulting from the upper light source mount 136 being cut from a flat piece of metal. In one exemplary embodiment, the upper light source mount 136 is precision manufactured from a single piece of sheet aluminum in order to maximize heat transfer precision of the angles. In another exemplary embodiment, the upper light source mount 136 can be precision cut from 0.090 inch thick 3033-H14 or 5052-H32 aluminum with a dimension a' of 0.748 inches and a neck 154 dimension b' of 0.500 inches to facilitate bending of the tongues 140.

A light source 156 is positioned on each tongue 112, 140. The light sources 156 depicted in FIGS. 4, 5A, 5B, 6A and 6B, are circuit boards 156, each with a LED 158 thereon. It is contemplated that some tongues could have no light source 156, such as in a lighting apparatus in which less than 360° of light is desired. In the depicted embodiment, the LED 158 of each circuit board 156 may optionally comprise, but need not, a lens immediately on the LED 158 such as, by way of example only, Luxeon Rebels sold by Philips Lumiled Lighting (e.g. LMP LED REBEL CWHT 100LM 350MA LXML-PWC1-0100 WN WO VN VO VP; LMP LED REBEL NWHT 100LM 350MA LXML-PWN1-0100 BC: TN, TO, TP). In the depicted embodiment, each circuit board 156 also comprises two connectors 160, one to receive and one to pass on current, in order to facilitate a serial daisy-chain connection of all of the circuit boards 156 on the upper light source mount 136 and, separately, on the lower light source mount 108. Each circuit board 156 comprises two holes that correspond with the holes 122, 152 in the upper and lower tongue ears 120, 150 to receive connectors. In the depicted embodiment, standard push-in connections commonly referred to as "pine-tree" connectors or clips are in the holes of the circuit boards 156 and corresponding holes 122, 152 to mount the circuit boards 156 to the light source mounting plates 118, 148 of the lower and upper tongues 112, 140. Other means and manners of connection will be apparent to those of ordinary skill in the art and are contemplated for use here.

As depicted, the portion of the circuit board 156 comprising the LED 158 is in contact with the light source mounting plates 118, 148 of the lower and upper tongues 112, 140, while the connectors 160 reside on a portion of the circuit boards 156 that extend beyond the light source mounting plates 118, 148. In this configuration, the heat generated by the LED may be directly communicated to the respective light source mounts 108, 136, then to the respective supports 102, 130 and ultimately to the fins 34, 62 and the shell portions 16, 22 and cap 26 where the heat can be dissipated to the surrounding environment. Optionally, a thermally conductive adhesive or other thermally conductive substance can be located between the light sources 156 and the tongues 112, 140 to optimize thermal communication.

While the exemplary embodiment depicted in the figures employs circuit boards 156 with LEDs 158 as the light sources, other light sources may also be employed or alternatively used within the scope of the present disclosure. By way of example only, other light sources such as plasma light sources may be used. Further, the term "LED" is intended to refer to all types of light emitting diodes including organic light emitting diodes ("OLED"). Use of LEDs can afford reduced energy, maintenance and costs when compared to other existing light sources.

Optionally, as depicted in the figures, an optic lens 162 is positioned over each LED 158 and is optionally held by a cylindrical optic lens holder 164. In one exemplary embodiment, the lower lighting assembly 100 comprises Luxeon Rebel LEDs, as discussed above, and 458633-FLP-W4-RE-HRFST lenses manufactured by Fraen Corporation of Reading, Mass. ("Fraen"). Other optic lenses 162 are contemplated on the on the lower lighting assembly 100 consistent with the particular lighting needs of the application of the lighting assembly. In another exemplary embodiment, the upper lighting assembly 128 comprises Luxeon Rebel LEDs, as discussed above, and 458634-FLP-M4-RE-HRFST lenses manufactured by Fraen. When the lighting assembly 10 is a bollard, it has been found advantageous to employ a narrow flood type optic lens on the upper lighting assembly 128 and a wide angle flood type optic lens on the lower lighting assembly 100.

In one embodiment of this disclosure, the upper lighting assembly 100 throws narrow flood beams of light (through a combination of light source 156 and lens 162) with the light directed an acute angle below horizontal toward the ground to light the far field, while the lower lighting assembly 128 throws wide flood beams of light (through a combination of light source 156 and lens 162) with the light directed at an angle below horizontal that is relatively wider than the acute angle of the upper light sources, to light the near field. In one example, the upper light source 156 is directed at an angle of 25.5° below horizontal and the lower light source 156 is directed at an angle of 38.6° below horizontal. These angles are determine by identifying the "direction" of the light as being perpendicular to the light source mounting plates 118, 148. The combination of the acute angle and the narrow flood beams used in the upper lighting assembly 100 and the relatively larger angle and wide flood beams used in the lower lighting assembly 128 facilitates appropriate lighting of both the near and far fields. Of course, the actual magnitude of lumens to be distributed to the near and far fields depends on the exact light sources 156 chosen and the current run through them.

In one exemplary embodiment, the lighting apparatus has the following dimensions, as identified in FIG. 2A c=4.679 inches, d=7.156 inches, e=30.107 inches, f=0.934 inches, g=1.831 inches. In this exemplary embodiment, angles $\alpha_l$=51.4° and $\alpha_u$=64.5°. In another exemplary embodiment, the LEDs are driven with a driver such as the driver disclosed in copending U.S. patent application Ser. No. 12/582,654 entitled Solid State Lighting, Driver Circuits and Related Software filed Oct. 20, 2009 and published as 2010/0117545, the entirety of which is incorporated herein by reference.

The blinds 56, 84 of the aperture frames 20, 24 may optionally extend downward a sufficient amount to block the light sources 156 and any optic lenses 162 from view of a pedestrian when viewing the lighting apparatus 10 perpendicular to its longitudinal axis. This prevents potentially harmful amounts of light from entering the pedestrian's eye.

The lighting apparatus 10 may optionally comprise a motion sensor to sense the presence of pedestrians nearby in order to have low or no light emitted when no pedestrians are present, while having high levels of light emitted when pedestrians are present. A microwave motion sensor 166 is depicted in FIGS. 4, 6A and 6B. The motion sensor may be of any known sort or configuration. A light sensor (not depicted) may also, or alternatively, used to cause the lighting apparatus 10 to emit light only when there is insufficient ambient light.

The upper and lower light apertures 80, 52 have been depicted and described herein as extending 360° about the longitudinal axis of the lighting apparatus 10, except as blocked by the upper and lower fins 62, 34. It is contemplated, but not depicted, that the upper and lower light apertures 80, 52 could extend anywhere from nearly 0° about the longitudinal axis to 360°. The light apertures could be blocked in areas where no light is desired. For example, 180° of the apertures 80, 52 could be blocked in order to throw light only across 180° in applications such as when the lighting apparatus 10 is located at or close to the edge of a sidewalk. Blocking the light apertures 80, 52 could be accomplished in many ways, such as, by way of example only, covering the lens with a blocking paint or inserting a reflector to cover the portions of the apertures 80, 52 to be blocked. Alternatively, or in addition, to blocking the apertures 80, 52, one or more light sources 156 could be removed from the upper and/or lower light assemblies 128, 100 in order to emit light only across the span desired to be lighted.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Headings and subheadings, if any, are used for convenience only and do not limit the invention.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configuration of the subject technology. A disclosure relating to an embodiment may apply to all embodiments, or one or more embodiments. An embodiment may provide one or more examples. A phrase such an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

Various modifications may be made to the examples described in the foregoing, and any related teachings may be applied in numerous applications, only some of which have been described herein. It is intended by the following claims to claim any and all applications, modifications and variations that fall within the true scope of the present teachings.

What is claimed is:

1. A lighting apparatus comprising:

a) a first lighting assembly comprising at least one lower light source configured to cast light over east a near field;

b) a second lighting assembly comp sing at east one upper light source configured to cast light over at least a far field, the second lighting assembly mounted above the first lighting assembly; and c) the at least one upper light source directed downward at an angle of approximately 25.5° from horizontal and the at east one lower light source directed downward at an angle from horizontal of approximately 38.6°.

2. The lighting apparatus of claim 1 wherein at least one of the upper and lower light sources is an LED.

3. The lighting apparatus of claim 1 wherein the upper light sources are configured to cast a narrow flood beam.

4. The lighting apparatus of claim 1 wherein the lower light sources are configured to cast a wide flood beam.

5. The lighting apparatus of claim 1 wherein the first angle is smaller than the second angle.

6. The lighting apparatus of claim 1 configured as a bollard wherein the second lighting assembly is located immediately over the first lighting assembly.

7. The lighting apparatus of claim 1 wherein at least one of the first and second lighting assemblies further comprises a light source mount comprising (a) a base defining a plane, (b) a plurality of tongues extending from the base at an angle to said plane, and (c) at least one of the plurality of tongues being configured to receive the light source.

8. A bollard configured as a column with an outer shell, the bollard comprising:

a) a lower light aperture adjacent the shell and a lower lighting assembly comprising at least one lower light source directed downward at a second angle from horizontal to cast light over at least a near field; and b) an upper light aperture adjacent the shell and a upper lighting assembly comprising at least one upper light source directed downward at a first angle from horizontal to cast light over at least a far field, the upper lighting assembly mounted above the first lighting assembly and the first angle is smaller than the second angle.

9. The bollard of claim 8 wherein at least one of the upper and lower light sources is an LED.

10. The bollard of claim 8 wherein the upper light sources are configured to cast a narrow flood beam.

11. The bollard of claim 8 wherein the lower light sources are configured to cast a wide flood beam.

12. The bollard of claim 8 wherein the first angle is approximately 25.5° and the second angle is approximately 38.6°.

13. The bollard of claim 8 configured as a bollard wherein the upper lighting assembly is located immediately over the first lighting assembly.

14. The bollard of claim 8 wherein at least one of the lower and second lighting assemblies further comprises a light source mount comprising (a) a base defining a plane, (b) a plurality of tongues extending from the base at an angle to said plane, and (c) at least one of the plurality of tongues being configured to receive the light source.

15. A light source mount for a lighting assembly, the light source mount comprising:

a) a base defining a plane and a perimeter;

b) a plurality of tongues extending from the perimeter of the base at an angle to said plane; and c) each tongue configured to receive one or more light sources.

16. The light source mount of claim 15, wherein each light source is comprised of an LED.

17. The light source mount of claim 15, wherein each of the plurality of tongues extends from the base at the same angle to the plane.

18. The light source mount of claim 15, wherein the plurality of tongues extend froze the base about the entirety of the perimeter.

19. A bollard configured as a column with outer she the bollard comprising:

a) a lower light aperture adjacent the shell and a lower lighting assembly comprising at least one lower light source directed downward at a second angle from horizontal to cast light over at least a near field; and b) an upper light aperture adjacent the shell and an upper lighting assembly comprising at least one upper light source directed downward at a first angle from horizontal to cast light over at east a far field, the upper lighting assembly mounted above the lower lighting assembly and the first angle is approximately 25.5° and the second angle is approximately 38.6°.

20. A bollard configured as a column with an outer shell, the bollard comprising:

a) a lower light aperture adjacent the shell and a lower lighting assembly comprising at least one lower light source configured to cast light over at least a near field;

b) an upper light aperture adjacent the shell and an upper lighting assembly comprising at least one upper light source configured to cast light over at least a far field, the upper lighting assembly mounted above the lower lighting assembly; and c) at least one of the lower and upper lighting assemblies further comprises a light source mount comprising (a) a base defining a plane, (b) a plurality of tongues extending from the base at an angle to said plane, and (c) at least one of the plurality of tongues being configured to receive a lower or upper light source.

21. A light source mount for a lighting assembly, the light source mount comprising:

a) a base defining a plane and a perimeter;

b) a plurality of tongues extending from the base about the entirety of the perimeter at an angle to said plane; and c) each tongue configured to receive one or more light sources.

* * * * *

UNITED STATES PATENT AND TRADEMARK OFFICE

CERTIFICATE OF CORRECTION

PATENT NO. : 8,585,238 B2
APPLICATION NO. : 13/107164
DATED : November 19, 2013
INVENTOR(S) : Mark James Krogman It is certified that error appears in the above-identified patent and that said Letters Patent is hereby corrected as shown below:

In the Claims:

Column 9, Claim 1, line 54, after "assembly" delete "comp sing at east" and insert: -- comprising at least --

Column 9, Claim 1, line 60, after "at" delete "east" and insert: -- least --

Column 10, Claim 18, line 55, after "extend" delete "froze" and insert: -- from --

Column 10, Claim 19, line 57, after "outer" delete "she" and insert: -- shell --

Column 10, Claim 19, line 66, after "at" delete "east" and insert: -- least --

Signed and Sealed this
Fifth Day of August, 2014

Michelle K. Lee

Michelle K. Lee
*Deputy Director of the United States Patent and Trademark Office*